US005752287A

United States Patent [19]

Wheat

[11] Patent Number: 5,752,287

[45] Date of Patent: May 19, 1998

[54] SCREW PAINT BRUSH

[76] Inventor: Richard Thomas Wheat, 492 N. Park Dr., Perth Amboy, N.J. 08861-1957

[21] Appl. No.: 724,326

[22] Filed: Oct. 1, 1996

[51] Int. Cl.[6] ..... A46B 15/00

[52] U.S. Cl. ..... 15/176.2; 15/143.1; 15/145

[58] Field of Search ..... 15/143.1, 144.1, 15/144.3, 145, 146, 176.1–176.6

[56] References Cited

U.S. PATENT DOCUMENTS

| | | | |
|---|---|---|---|
| 589,351 | 8/1897 | Humbach | 15/144.1 |
| 2,969,996 | 1/1961 | White, Jr. . | |
| 3,894,807 | 7/1975 | Betz, III | 15/146 X |
| 4,157,598 | 6/1979 | Talent et al. | 15/146 X |
| 4,447,927 | 5/1984 | Malless, Jr. | 15/145 X |
| 4,471,507 | 9/1984 | Schwartz | 15/176.1 |
| 4,494,268 | 1/1985 | Chu | 15/176.1 |
| 4,525,889 | 7/1985 | Dunau | 15/146 |
| 4,715,080 | 12/1987 | Rydzicki | 15/146 |
| 5,329,663 | 7/1994 | Council | 15/143.1 |
| 5,359,749 | 11/1994 | Chu | 15/176.1 |
| 5,385,420 | 1/1995 | Newman, Sr. et al. | 403/299 |
| 5,502,859 | 4/1996 | Kim | 15/144.1 |

FOREIGN PATENT DOCUMENTS

| | | | |
|---|---|---|---|
| 1124213 | 5/1982 | Canada | 15/145 |
| 808421 | 2/1937 | France | 15/145 |
| 1335882 | 7/1963 | France | 15/145 |

*Primary Examiner*—Mark Spisich

[57] ABSTRACT

The present invention relates to a screw paint brush (10) consisting of a connector which comprises a connector front and a connector rear having a connector rear opening therein. The screw paint brush (10) further comprises a handle (14) which comprises a handle front (14A) having a handle front fastening, member (14AA) securely attached thereto. The handle (14) further comprises a handle rear (14B) which is securely attached to the handle front (14A) by a handle middle (14C). The handle rear (14B) further comprises a handle rear opening (14BA) therein which functions to accept an extension pole therein. The handle front fastening member (14AA) is removably attachable within the connector rear opening. Alternatively, the handle (14) and brush (16) can be manufactured in a single piece. The screw paint brush (10) further comprises a brush (16) which comprises a brush rear (16B) and a brush front (16A) having a plurality of brush bristles (16C) extending therefrom and securely attached thereto. The brush rear (16B) is securely attached to the connector front. The connector may be a straight connector (212) or angled connector (112).

6 Claims, 3 Drawing Sheets

SCREW PAINT BRUSH

FIELD OF THE INVENTION

The present invention relates to hair brushes. More particularly, the present invention relates to a one-piece screw-in paint brush with threads in the rear of the brush. In addition, the present invention relates to hair brushes with removable handles for the purpose of changing the handle size in order to better paint difficult to reach areas of a wall or ceiling.

DESCRIPTION OF THE PRIOR ART

The common method of painting the comers of ceilings and moldings requires the user to climb a ladder to paint small areas with a standard sized brush, or alternatively, to utilize a brush with a handle that is removably attached by a coupling assembly or resilient arm assembly. The problems associated with this method of attachment are numerous. Firstly, the removable brush handles are cumbersome and inconvenient to use during painting. Secondly, the removable brush handles loosen when the user asserts constant pressure and stress upon the handle. What is needed, therefore, is a device which allows for the convenient attachment and detachment of paint brush handles which allows the user to vary the length of the paint brush according to the difficulty of reaching the area to be painted. Specifically, a device is needed which will allow for a tightly yet removably secured paint brush handle, which can accept an extension piece through threads located at the rear of the brush handle, which the user will remove or replace when painting the comers of ceilings or moldings. In addition, a device is needed whereby the user can also discard only the bristle portion of a brush when the bristles become warn or damaged.

Numerous innovations for a screw paint brush have been provided in the prior art that are described as follows. Even though these innovations may be suitable for the specific individual purposes to which they address, they differ from the present invention as hereinafter contrasted.

In U.S. Pat. No. 5,359,749, Titled, Paint Brush With Replaceable Head, invented by Chu, a paint brush with replaceable head comprises a handle and a bristle portion detachably secured to the handle by a removable pin. The bristle portion consists of bristles fixedly mounted onto the lower end of a retaining member by adhesives.

The present invention differs from the above described patented invention teaches the use of a removable pin to secure the paint brush handle to the connector. The pin of the Chu invention can be inserted in to the aperture of the chamber either through the front and back of the chamber, or through the sides of the chamber. The present invention, in contrast, uses a screw or other fastening means to securely and removably attach the connector and handle of a paint brush resulting in tighter, stronger fit.

In U.S. Pat. No. 4,713,080, Titled, Brush Extension Handle, invented by Rydzyki an attachment for holding and adjustably positioning a brush is disclosed. It is substantially provided to be mounted on an extension rod, and enables an operator ease in converting difficult to reach areas.

The present invention differs from the above described patented invention because the Rydzyki invention provides for angling a paint brush by the attachment of an elongated extension member to the existing paint brush handle. The present invention accomplishes a convenient means for the user to paint difficult areas simply by the interchanging of removable paint brush handles.

In U.S. Pat. No. 4,471,507, Titled Paint Brushes With Detachable Handles, invented by Schwartz, a paint brush is described as having a handle which is composed of two sections which are normally joined together in end to end relation, but which can be interchangeably used with a number of differently sized ferrules that contain fibers. The ferrules are each provided with a special adapter to which a single handle can be detachably mounted.

The present invention differs from the above described patented invention because the Schwartz invention provides a paint brush handle consisting of two sections with a removable second section. Specifically designed for use by highly skilled artisans and calligraphers, the Schwartz invention accomplishes the interchangability of small brush tips. Unlike the patented invention, the present invention by Wheat describes a standard paint brush with a removable handle, which enables the user to paint the comers of ceilings, mouldings, and other difficult to reach areas by simply releasing a handle and fastening to the connector a longer extension handle.

In U.S. Pat. No. 4,494,268, Titled Paint Brushes, invented by Chu, a paint brush comprises a handle and a handle portion detachably secured to the handle. The bristle portion consists of bristles fixedly mounted in a retaining member which is received in a hollow portion of the handle. A pair or resilient arms are provided on the retaining member and are formed with projections which engage in the hollow portion of the handle.

The present invention differs from the above described patented invention because the Chu invention requires the usage of resilient arms engaged in apertures to secure the bristle portion to the handle. In the Chu invention, the user must apply pressure to the arms inwardly with respect to the bristle portion in order to disengage the arms from their respective apertures. Unlike in the Chu patent, the present invention by Wheat allows for a more securely attached bristle portion and removable handle, as such are connected by a screw or similar fastening means. Therefore, the handle of the present invention will not loosen upon the user applying force to or stress on the brush during difficult painting.

In U.S. Pat. No. 4,157,598, Titled Paint Brush Having Detachable Extension Rod, invented by Talent et al., a paint brush having a handle extending from a stock into which bristles are fastened is provided with an adaptor to which an extension rod or pole may be attached. The adaptor is connected to a stock adjacent to the termination of the handle, in the stock, and at an angle to the handle. The adaptor, handle, and stock are in coplanar arrangement. The adaptor is constructed to releasably receive an extension rod, preferably in threaded engagement. With the extension rod, the improved paint brush may be used to paint floor and ceiling moldings and the junction between floors and ceilings without the aid of a ladder.

The present invention differs from the above described patented invention because the Talent invention demands the use of a second device or extension rod, to enable the user to access difficult to reach areas during painting. The present invention by Wheat, unlike the Talent patent, describes a removable paint brush handle which gives the user the ability to change to a paint brush handle of greater length without the use of any other apparatus.

In U. S. Pat. No. 5,329,663, Titled Multiple Angle Paint Brush Holder, invented by Council, a paint brush holder having an threaded opening for receiving a standard threaded extension rod of any desired length. The paint brush holder further includes a unique handle clamp for securely retaining the handle of the paint brush at multiple angles with respect to the received extension rod. By securing the paint brush at the desired angle and attaching the extension rod, a painter is able to access and paint, in a controlled manner, high, hard to reach painting locations such as ceilings, corners, mouldings and trim.

The present invention differs from the above described patented invention because the patented invention, much like the patent by Talent, requires the usage of a second device, in this instance the brush holder, to access difficult to reach areas during painting. Thus, the present invention by Wheat is unlike the Council invention, because the patented invention describes a removable paint brush handle which gives the user the ability to change the length of the paint brush handle without the use of any other apparatus.

In U.S. Pat. No. 5,385,420, Titled Coupling Assembly, invented by Newman, Sr. et al., a threaded snap-fit coupling assembly is provided for use in attaching a handle to an implement, such as a paint brush, paint pad, light bulb changer, cleaning brush or the like. The assembly includes an adaptor provided with a cylindrical receptacle and a male fastening member that is externally threaded and sized for threaded receipt in a threaded opening of the implement so that the adaptor may be connected to the implement. The assembly also includes a coupling provided with a first end that is retained on the handle, and a cylindrical male portion that is externally threaded sized for threaded receipt in the opening of the implement and for sliding receipt within the receptacle of the adaptor. The coupling is retained on the adaptor via a snap-fit connection when the male portion of the coupling is received in the receptacle of the adaptor. This connection permits removal of the coupling from the adaptor when the coupling is pulled from the receptacle with a force sufficient to overcome the holding force of the snap-fit connection.

The present invention differs from the above described patented invention because the patented invention requires the usage of a coupler for the purpose of attaching the removable handle, whereas the present invention utilizes a screw or other fastening means. As such, the present invention provides a more secure fit between the brush handle and the connector, and the handle of the present invention will not loosen upon the user applying force to or stress on the brush during difficult painting.

Numerous innovations for a screw paint brush have been provided in the prior art that are adapted to be used. Even though these innovations may be suitable for the specific individual purposes to which they address, they would not be suitable for the purposes of the present invention as heretofore described.

SUMMARY OF THE INVENTION

The types of problems encountered in the prior art are heavy and cumbersome means of extending paint brushes, and removable handles which were not attached securely enough to withstand the pressure exerted by the user on the handle during painting of difficult to reach areas.

In the prior art, unsuccessful attempts to solve this problem were attempted namely: extension handles attached to the existing paint brush handles, and removable paint brush handles, which were attachable to the bristle portion by coupling assemblies and resilient arm means. However, the problem was solved by the present invention because the present invention provides for the convenient attachment or detachment of paint brush handles by a screw or similar fastening means, which provides a tightly secured attachment of the handle to the connector or bristle portion.

Innovations within the prior art are rapidly being exploited in the field of producing extendable and removable paint brush handles.

The present invention went contrary to the teaching of the art which teaches adding elongated extension members to the paint brush handle and removable handle attachment by couplings and resilient arms.

The present invention solved a long felt need for the convenient removal and attachment of alternate paint brush handles for the purpose of extending the brush in order to reach high and difficult areas, whereby the paint brush handle can accept an extension piece through threads located at the rear of the brush handle. In addition, the present invention solved a long felt need for the convenient replacement of only the brush's bristle portion when the bristles are worn or damaged.

Accordingly, it is an object of the present invention to provide a screw paint brush.

More particularly, it is an object of the present invention to provide a screw paint brush consisting of a handle which comprises a handle front having a handle front fastening means securely attached thereto, a connector comprising a connector front and a connector rear having a connector rear opening therein, and a brush which comprises a brush front having a plurality of brush bristles extending therefrom and securely attached thereto and a brush rear securely attached to the connector front.

In keeping with these objects, and with others which will become apparent hereinafter, one feature of the present invention resides, briefly stated, in a screw paint brush in which the connector can be a straight connector or an angled connector.

In accordance with another feature of the present invention, the present invention utilizes a screw or similar fastening means to securely, yet removably, attach the brush handle to the connector or bristle portion of the paint brush, allowing for the convenient removal and attachment of alternate paint brush handles to extend the brush to reach high areas, and to replace only the brush's bristle portion when the bristles become worn or damaged.

Another feature of the present invention is that the handle rear further comprises a handle rear opening which functions to accept an extension pole therein.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

COMMON COMPONENTS TO EMBODIMENTS

14—handle (14)
14A—handle front (14A)
14AA—handle front fastening means (14AA)
14B—handle rear (14B)
14BA—handle rear opening (14BA)
14BB—handle rear threads (14BB)
14C—handle middle (14C)
16—brush (16)

16A—brush front (16A)
16B—brush rear (16B)
16C—brush bristles (16C)
FIRST EMBODIMENT
10—screw paint brush (10)
112—straight connector (112)
112A—straight connector front (112A)
112B—straight connector rear (112B)
112BA—straight connector rear opening (112BA)
SECOND EMBODIMENT
212—angled connector (212)
212A—angled connector front (212A)
212B—angled connector rear (212B)
212BA—angled connector rear opening (212BA)

DESCRIPTION OF THE PREFERRED EMBODIMENT

Figure 1:
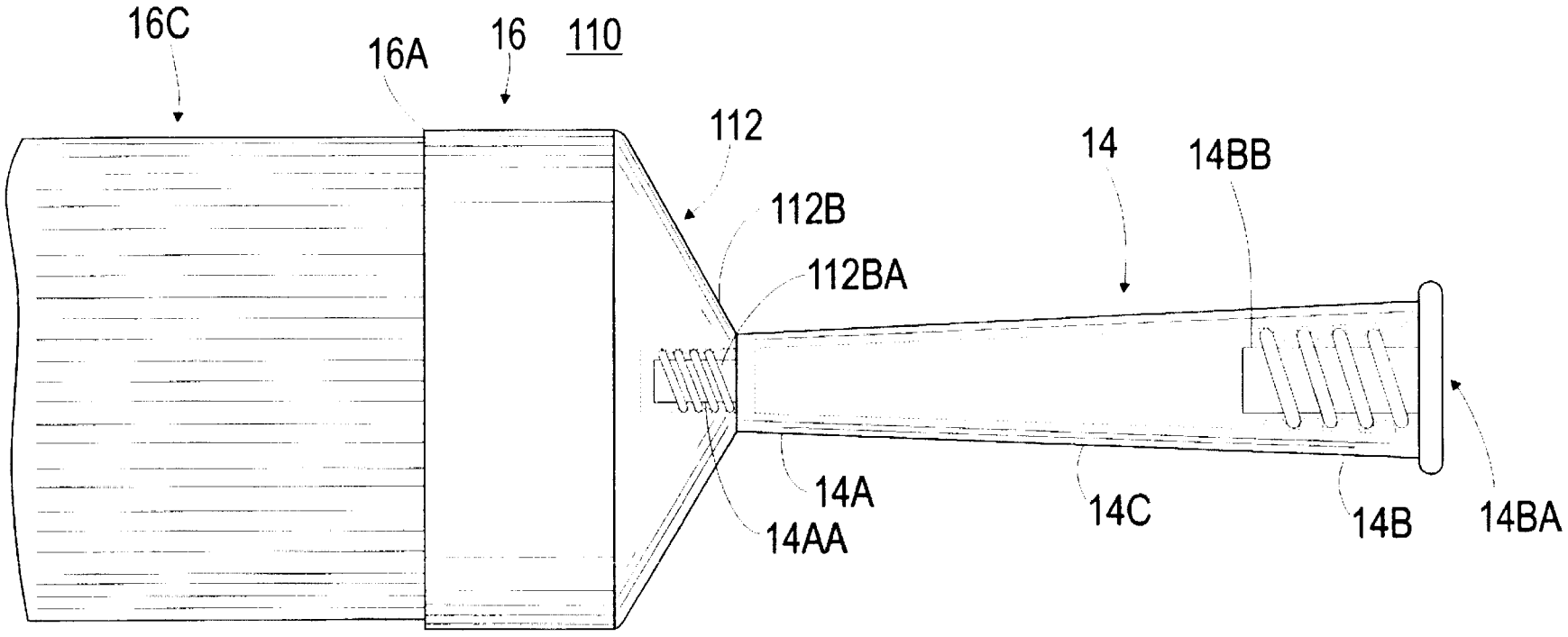
FIG. 1 is a top view of a screw paint brush exhibiting a straight connector.
Figure 2:
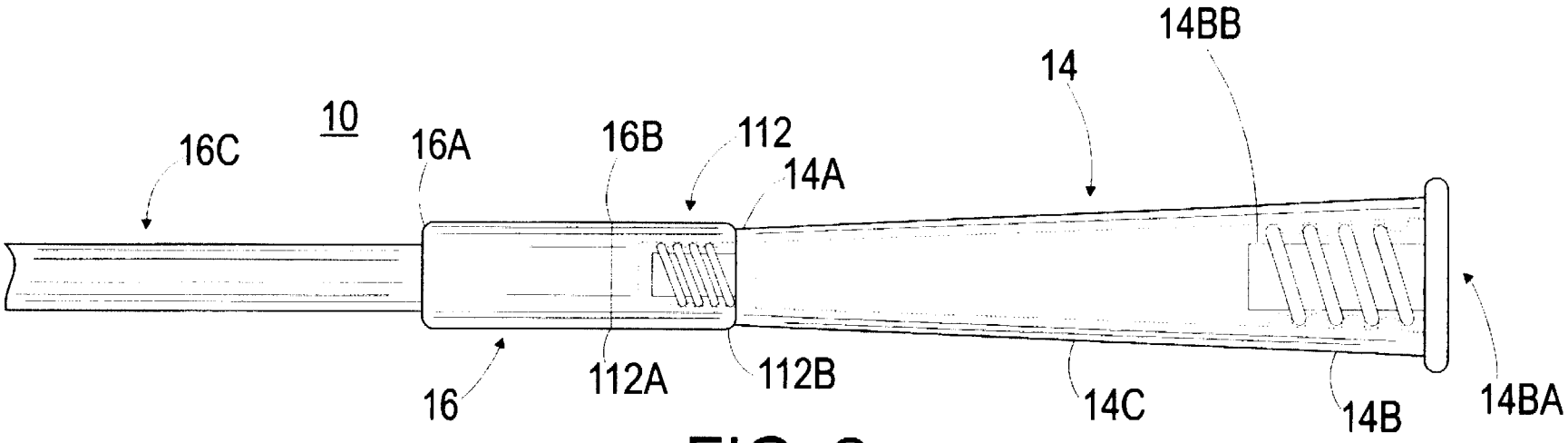
FIG. 2 is a side view of a screw paint brush exhibiting a straight connector.

Referring to FIG. 1 and FIG. 2 which are a top view and a side view, respectively, of a screw paint brush (10) exhibiting a straight connector (112). The screw paint brush (10) comprises a connector which comprises a connector front and a connector rear having a connector rear opening therein. The screw paint brush (10) further comprises a handle (14) which comprises a handle front (14A) having a handle front fastening means (14AA) securely attached thereto. The handle (14) further comprises a handle rear (14B) which is securely attached to the handle front (14A) by a handle middle (14C). The handle rear (14B) further comprises a handle rear opening (14BA) therein which functions to accept an extension pole or extension handle in handle rear threads (14BB). An extension handle can be attached to the handle rear opening (14BA) for the purpose of extending the length of the handle (14) so that the user can more conveniently access high, difficult to reach areas on ceilings and moldings. The handle front fastening means (14AA) is removably attachable within the connector rear opening, which further allows the user to remove the handle and securely attach an alternate handle of an extended or shorter length. In the preferred embodiment, the fastening means (14AA) is a screw assembly to tightly and securely attach the handle (14) to the connector opening. Alternatively, the screw paint brush (10) can be manufactured in a single piece construction so that the handle (14) is securely attached to the brush (16) without use of the aforementioned fastening means (14AA).

The screw paint brush (10) further comprises a brush (16) which comprises a brush rear (16B) and a brush front (16A) having a plurality of brush bristles (16C) extending therefrom and securely attached thereto. The brush rear (1 6B) is securely attached to the connector front. In FIG. 1 and FIG. 2, the connector is a straight connector (112) which comprises a straight connector front (112A) attached to a straight connector rear (112B) having a straight connector rear opening (112BA) therein. The straight connector (112) allows the user to effectively paint the edge and corners of a ceiling. The handle (14), the brush (16), and the straight connector are manufactured from a material selected from a group consisting of plastic, plastic composite, wood, fiberglass, epoxy, carbon-graphite, rubber, rubber composite, metal, and metal alloy. The brush bristles (16C) are manufactured from a material selected from a group consisting of natural fibers, plastic and plastic composite.

Figure 3:
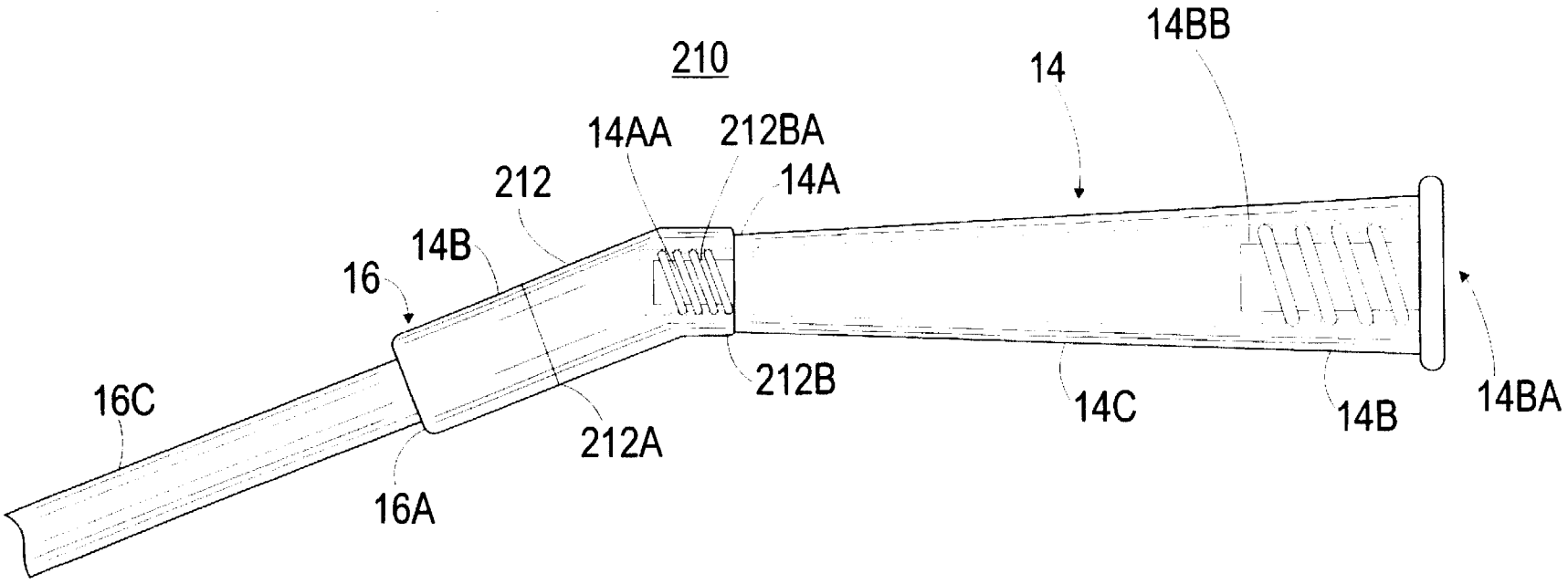
FIG. 3 is a top view of a screw paint brush exhibiting an angled connector.

Lastly, referring to FIG. 3 which is a top view of a screw paint brush (10) exhibiting an angled connector (212). The angled connector (212) comprises an angled connector front (212A) securely and removably attached to an angled connector rear (212B), the angled connector rear (212B) having an angled connector rear opening (212BA) therein. The angled connector (212) can be manufactured at any angle needed to effectively allow the user to effectively paint the edge, corners, and top of a wall adjacent to the ceiling. The angled connector (212) is manufactured from a material selected from a group consisting of plastic, plastic composite, wood, fiberglass, epoxy, carbon-graphite, rubber, rubber composite, metal, and metal alloy.

It will be understood that each of the elements described above, or two or more together, may also find a useful application in other types of constructions differing from the type described above.

While the invention has been illustrated and described as embodied in a screw paint brush, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A paint brush comprising:

(a) an elongated, one-piece unitary handle having opposite first and second ends, said first end having a planar surface and an externally threaded member extending therefrom in axial alignment with the longitudinal axis of the handle and perpendicular to the planar surface of the first end of the handle, said externally threaded member being of a reduced diameter with respect to said handle, said second end having an internally threaded elongated opening in axial alignment with said longitudinal axis and enabling said handle to be connected to an extension pole having external threads on an end thereof, said second end of the handle having a thickened bead portion;

(b) a connector having opposite front and rear portions, the rear portion of the connector having a planar surface and an internally threaded elongated opening which is perpendicular to the planar surface of the rear portion of the connector, the internally threaded opening of the connector cooperating with the externally threaded member of the handle, the front portion of the connector also having a planar surface; and (c) a brush having a planar rear portion connected to the planar surface of the front portion of the connector, said brush further having a planar front portion which is parallel to the planar rear portion of the brush, said planar front portion further having a plurality of bristles extending therefrom and perpendicular thereto.

2. The paint brush as described in claim 1, wherein the handle, the brush, and the connector are manufactured from a material selected from the group consisting of plastic, plastic composite, wood, fiberglass, epoxy, carbon-graphite, rubber, rubber composite, metal, and metal alloy.

3. The paint brush as described in claim 1, wherein the brush bristles are manufactured from a material selected from the group consisting of natural fibers, plastic and plastic composite.

4. The paint brush of claim 1 wherein said connector is straight and wherein the planar surface of the front portion of the connector is parallel to the planar surface of the rear portion of the connector.

5. The paint brush of claim 1 wherein said connector is angled and wherein the planar surface of the front portion of the connector is oblique with respect to the planar surface of the rear portion of the connector.

6. A paint brush comprising:

(a) an elongated, one-piece unitary handle having opposite first and second ends, said first end having a planar surface and an externally threaded member extending therefrom in axial alignment with the longitudinal axis of the handle and perpendicular to the planar surface of the first end of the handle, said second end having an internally threaded elongated opening in axial alignment with said longitudinal axis and enabling said handle to be connected to an extension pole having external threads on an end thereof;

(b) a connector having opposite front and rear portions, the rear portion of the connector having a planar surface and an internally threaded elongated opening which is perpendicular to the planar surface of the rear portion of the connector, the internally threaded opening of the connector cooperating with the externally threaded member of the handle, the front portion of the connector also having a planar surface, the planar surface of the front portion of the connector being fixed at a non-parallel orientation with respect to the planar surface of the rear portion of the connector so as to result in an angled connector; and (c) a brush having a planar rear portion connected to the planar surface of the front portion of the connector, said brush further having a planar front portion which is parallel to the planar rear portion of the brush, said planar front portion further having a plurality of bristles extending therefrom and perpendicular thereto.

* * * * *